United States Patent [19]

Wafer et al.

[11] 4,042,895

[45] Aug. 16, 1977

[54] COMBINATION MOTOR-STARTER AND CIRCUIT BREAKER

[75] Inventors: John A. Wafer, Monroeville; Paul G. Slade, Pittsburgh, both of Pa.

[73] Assignee: Westinghouse Electric Corporation, Pittsburgh, Pa.

[21] Appl. No.: 613,840

[22] Filed: Sept. 16, 1975

[51] Int. Cl.[2] ..... H01H 77/10; H01H 73/00

[52] U.S. Cl. ..... 335/16; 335/6; 335/174

[58] Field of Search ..... 335/16, 195, 147, 170, 335/174, 20, 13, 6

[56] References Cited

U.S. PATENT DOCUMENTS

| | | | |
|---|---|---|---|
| 3,651,436 | 3/1972 | Cooper et al. | 335/13 |
| 3,663,903 | 5/1972 | Kussy et al. | 335/16 |
| 3,703,691 | 11/1972 | Gryctko et al. | 335/20 |
| 3,824,508 | 7/1974 | Terracol | 335/16 |
| 3,987,382 | 10/1976 | Cataldo et al. | 335/16 |

*Primary Examiner*—Harold Broome

*Attorney, Agent, or Firm*—Robert E. Converse, Jr.

[57] ABSTRACT

A combination motor-starter circuit breaker comprising a single set of separable contacts and providing the function of motor starting, circuit interruption, and current limiting. The combination employs three separate means for separating the contacts to provide these functions; a solenoid, an overcurrent trip mechanism, and a magnetic drive device for high overcurrent conditions. Arc rails and spaced conductive plates are provided to aid in extinguishing any arcs established. Movable contacts are mounted on a bridging contact arm which can be provided with two open positions, a first position for use during motor control wherein the contacts are separated by a relatively small distance and a second position for use during circuit interruption and current limiting.

18 Claims, 6 Drawing Figures

COMBINATION MOTOR-STARTER AND CIRCUIT BREAKER

CROSS REFERENCE TO RELATED APPLICATION

The invention disclosed in the instant application is related to the following; (1) U.S. application No. 587,791, filed June 16, 1975, (2) U.S. Pat. application No. 503,232, filed Sept. 5, 1974, and (3) U.S. Pat. application No. 533,413, filed Feb. 11, 1975.

BACKGROUND OF THE INVENTION

1. Field of the Invention:

This invention is related to a motor-starter and more particularly to a combination motor-starter circuit breaker wherein a single set of contacts are used for operation and protection of the motor and its associated circuit.

2. Description of the Prior Art:

Prior art combination motor-starter as exemplified by U.S. Pat. No. 3,638,157 issued to Z. J. Kruzic and assigned to the assignee of the present application are provided with separate units which provide for (1) motor-starting and stopping; (2) current interruption; and, (3) current limiting.

It is old in the art to provide a plurality of motor control and circuit protection devices in series in a common enclosure for motor circuit protection. It is also old in the art to provide a fused switch motor starter combination comprising: a contactor with overload relays for automatically opening the contactor and the motor circuit upon the occasion of lesser overload currents caused by motor overload, current limiting fuses for interrupting low level to high level fault current, and a manually operable switch for permitting manual opening and closing of the motor circuit.

It is also old to provide a fused breaker motor starter combination comprising: a contactor with an overload relay for opening the motor circuit upon the occurrence of low overload currents; a manually operable circuit breaker automatically operable to interrupt the motor circuit upon the occurrence of low level to high level faults; and current limiting fuses that operate upon the occurrence of a heavy short circuit current. Prior art motor-starters normally are a dual break device which usually have silver cadmium oxide contacts. A solenoid mechanism is used to close the contacts. Contacts are spring biased open and are automatically reopened if the system voltage is lost. Low to high level fault protection is provided by a series connected molded case circuit breaker. The circuit breaker can be a single break Deion circuit breaker with an adjustable magnet trip. For long life, durability, and erosion and weld resistance, silver tungsten contacts are often used in the circuit breaker. The adjustable magnetic trip is set to operate the breaker at from 7 to 13 times full load current. The molded case circuit breaker is capable of operation to interrupt high overload currents. For example, in a NEMA Size One device having a 100 ampere rating, the circuit breaker can interrupt currents up to 15,000 amperes up to three times. Current limitation is provided by current limiting fuses connected in series with the contactor and molded case circuit breaker for protection against possible faults up to 100,000 amperes RMS symmetrical. In addition a thermal trip relay which can be adjusted to open the motor-starter at currents below the molded case circuit breaker trip level with an appropriate delay are often provided. It is also common to provide a series connected disconnect switch.

It can be seen that to obtain full motor circuit protection in the prior art a plurality of series connected devices are necessary. This prior art construction is expensive and the power loss across the plurality of devices is greater than that which occurs across a single motor contactor. Also, it is necessary to change fuses after a high current limiting operation.

SUMMARY OF THE INVENTION

A combination motor-starter circuit breaker is provided which contains all the advantages and features of prior art combination starters and utilizes only a single set of contacts for each line connection. A solenoid is provided for moving the contacts to the open or closed position for operation of the associated motor. A trip mechanism, which can be of the flux transfer variety, can be utilized for low to high fault current protection. A magnetic drive device or linear slot motor can be used to rapidly open the contacts and provide current limiting for possible high fault current.

In one embodiment of the invention a bridging contact arm is provided upon which are mounted spaced apart contacts. These contacts are disposed in alignment with stationary contacts mounted inside of the motor starter housing. The bridging contact arm is movable between a closed position wherein the movable contacts engage the stationary contacts and an open position wherein the movable contacts are spaced apart from the stationary contacts. The bridging contact arm can be moved to the open position by an electromagnet or solenoid, a tripping device, or a current limiting device. Spacing in the open position of the bridging arm can be different for each of these three opening devices, as desired. For example, it may be desirable when the bridging contact arm is controlled by the solenoid for the motor control to provide for an open position wherein the movable contacts are separated from the stationary contacts by a relatively small distance. When the bridging contact arm is opened by the trip mechanism or the current limiting mechanism the spacing can be greater.

In one embodiment of the invention the contacts of the starter are only separated by a relatively small distance but are provided with diverging arcing rails extending therefrom to rapidly move the arc from the contact area into the arc extinguishing plates. The moving contacts can be connected to the arc rails by a flexible connection. When the starter is opened any arc formed is rapidly propelled along the arc rails which have diverging ends. Deion plates are disposed around the diverging ends of the arc rails to provide for rapid arc extinction.

The current limiting drive device opens the starter contacts when a predetermined excessive fault current passes through the starter. A bridging contact arm is disposed in a slot formed in a magnetic member and during large fault currents the magnetic forces generated rapidly draw the bridging contact arm further into the slot opening.

During lower fault currents a flux transfer device, which can be operated by current supplied from a current transformer, unlatches and trips open the breaker. The flux transfer device is provided with a permanent magnet having two pole pieces with a movable keeper providing a low reluctance path between the pole pieces when in the latched position and a fixed keeper providing a high reluctance path. A trip coil is disposed around the fixed keeper which when energized shifts the flux path to the higher reluctance path through the fixed keeper. The movable keeper is unlatched and, due to a spring biasing force, is moved away from the pole pieces, opening the contacts of the integral starter.

It is an object of this invention to teach an integral motor-starter having a movable contact which is operable by a plurality of opening mechanisms to provide for complete motor circuit protection and motor operation.

It is a further object of this invention to teach a combination motor-starter having a bridging contact assemby which can be opened a first distance for motor operation and a second greater distance for motor circuit protection.

It is still a further objective of this invention to teach an integral motor-starter wherein a single device utilizing only one movable contact assembly can provide for motor operation, motor circuit protection and current limiting.

BRIEF DESCRIPTION OF THE DRAWINGS

For a better understanding of the invention, reference may be had to the preferred embodiment exemplary of the invention shown in the accompanying drawings in which.

DESCRIPTION OF THE PREFERRED EMBODIMENT

Figure 2:
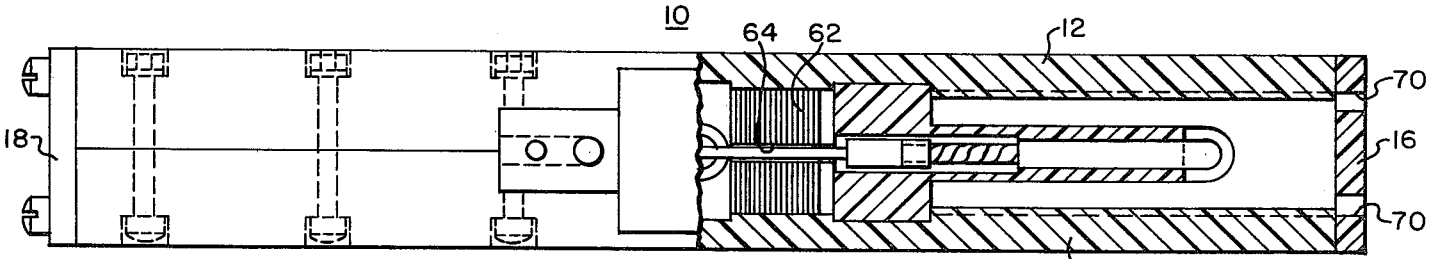
FIG. 2 is a top view of the combination starter shown in FIG. 1.
Figure 1:
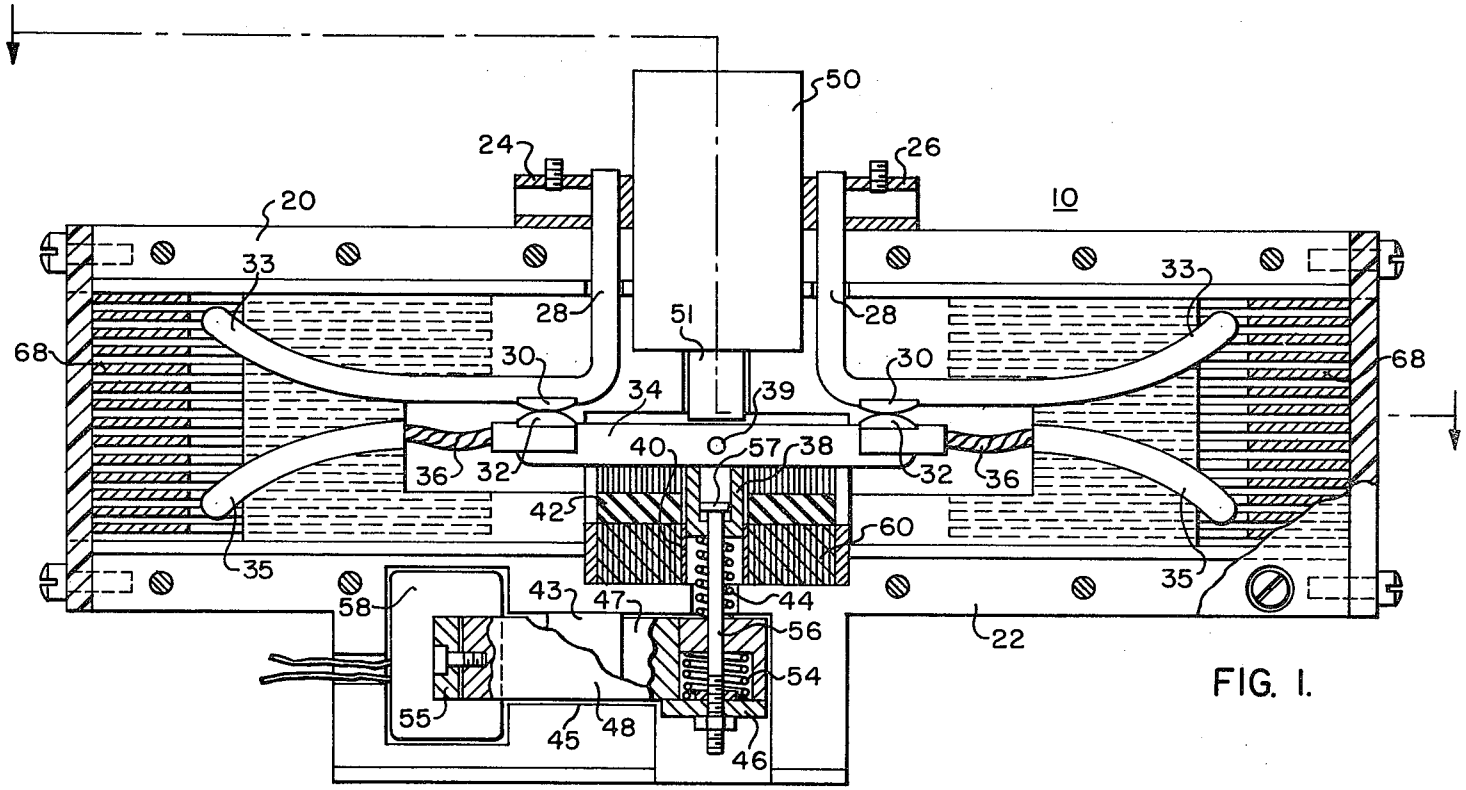
FIG. 1 is a side section view of a combination motor-starter and circuit breaker utilizing the teaching of the present invention.

Referring now to the drawings and FIG. 1 and FIG. 2 in particular there is shown a combination circuit breaker and motor-starter 10 utilizing the teaching of the present invention. Although the starter 10 is disclosed as a single pole device, it is understood that it may be used for any number of poles such as a three-pole unit. Starter 10 is formed within an insulating housing comprising side members 12 and 14, end members 16 and 18, an insulating top cover 20, and an insulating bottom cover 22. Terminals 24 and 26 are provided for connecting starter 10 in the line feeding the controlled motor. Two generally L-shaped conductors 28 extend from the terminals 24 and 26, one from connecting terminal 24 and the other from terminal 26. A stationary contact 30 is mounted on each conductor 28. Associated moving contacts 32 supported from a bridging contact arm 34 are aligned with stationary contacts 30. Thus with starter 10 in the closed position a continuous current path exists from terminal 24 through conductor 28 through contact pairs 30 and 32 through bridging arm 34 through contacts 32 and 30 through conductor 28 to terminal 26. It can be seen that the conductors 28 extend beyond fixed contacts 30 to form arc rails 33 extending outward from fixed contacts 30. A second pair of arc rails 35 which are connected by a flexible connection 36 to movable contacts 32 extend in diverging relationship with the arc rail ends 33 of the conductors 28. When contacts 30 and 32 are separated slightly during circuit interruption, an arc can form therebetween. Any arc formed between contacts 30 and 32 is rapidly expelled outward along arc rails 33 and 35.

During the operation, separation of contacts 30 and 32 is kept relatively small to effect extremely fast movement of an established arc along arc rails 33 and 34 into an arc extinguishing apparatus 68. In a low voltage circuit it is not necessary to have large contact gaps in order to withstand typical open circuit voltages that will occur. For example, under very poor conditions a gap of 0.2 inches will withstand between 5kv and 17kv and even at 0.04 inches the gap will still withstand between 2kv and 5kv. A high current arc between closely spaced contacts, however, causes severe erosion and the ionized plasma still present after current zero can cause reignition of the arc. Some preliminary experiments have shown that parallel arc rail arrangements have some major advantages. First, at close spacing the arc is swept off of contacts 30 and 32 very rapidly by the influence of the self-induced magnetic field. This prevents excessive erosion of the contact and also the ionized plasma is swept away from the contact region enhancing the chances of dielectric recovery after current zero. Secondly, the arc is forced to lengthen as the arc rail diverges. This causes the arc voltage to increase and give rise to some current limiting. Arc rails 33 and 35 diverge and extend outward from contacts 30 and 32 facilitating arc extinction. When open, the separation between contacts 30 and 32 is preferably on the order of one-quarter inches or less. For a more complete description of arc movement along closely spaced diverging arc rail reference may be had to copending U.S. application No. 587,781, (W.E. 41,977).

Bridging contact arm 34 is pinned to a round hollow slidable shaft 38. Shaft 38 slides in a suitable sleeve 40 which can be formed from a low friction material such as nylon, Teflon, or the like. Pin 39 which connects bridging contact arm 34 to shaft 38 allows for a small rotation of bridging arm 34 to compensate for uneven contact wear. Shaft 38 and sleeve 40 provide a guide for the contact arm 34 which moves approximately one-quarter inch during operation. A bumper 42 formed of resilient material is provided to limit the travel of bridging contact arm 34 and to act as a shock absorber upon opening. The contact holding force is provided by a spring 44 between shaft 38 and a stop on a shaft 56 which is connected to a keeper 46. An electromagnet or solenoid 50 is provided to move bridging contact arm 34 for motor starting and stopping. Solenoid 50 is spring biased in an extended down position so that when solenoid 50 is unenergized, contact bridging arm 34 is maintained in a down position with contacts 30 and 32 spaced apart. When solenoid 50 is energized, shaft 51 retracts and the contact force spring 44 moves bridging arm 34 up, thereby closing contacts 30 and 32. When solenoid 50 is deenergized, spring biased shaft 51 forces bridging contact arm 34 down into engagement with bumper 42.

A flux transfer assembly 45 is provided for tripping open starter 10 under selected conditions. Flux transfer device 45 consists of a permanent magnet 43 with pole pieces 47 and 48 on each side forming a sandwich. Pole pieces 47 and 48 are supported adjacent to the opposite poles of permanent magnet 43. Movable keeper 46, when in the latched position, is in contact with pole pieces 47 and 48. When movable keeper 46 is in a latched position as shown in FIG. 1, opening spring 54 is compressed. Opening spring 54 urges movable keeper 46 to an unlatched position spaced apart from pole pieces 47 and 48. A fixed keeper 55, providing a higher reluctance alternate flux path, is attached to one end of pole pieces 47 and 48. When movable keeper 46 is in engagement with pole pieces 47 and 48, the majority of flux from permanent magnet 43 flows therethrough. This holds movable keeper 46 in engagement with pole pieces 47 and 48 with a predetermined force. Movable keeper 46 is attached to shaft 56 which has an enlarged head 57 engaged in an opening in hollow shaft 38. Shaft 56 is connected to shaft 38 in a lost motion relationship so that some relative motion of shaft 38 or shaft 56 is possible before the other will be moved. A trip coil 58 is disposed around the fixed keeper 55. When trip coil 58 is energized, the movable keeper 46 is unlatched and moved to an open position under the influence of spring 54. As movable keeper 46 moves, shaft 56 is pulled into engagement with the closed end of hollow shaft 38 opening the movable contact arm 34. An adjustable magnetic trip circuit (not shown) is used to open the set of contacts 30 and 32 by energizing the trip coil 58 at any desired overload point. The magnetic trip can be made to trip very fast or trip after a delay which is a function of time and current flow.

In the flux transfer device permanent mangent 43 has two alternate flux paths. Movable keeper 46 completes one path and fixed keeper 55 completes the other path. The flux path through keeper 55 is biased so as to increase its reluctance, as by placing an air gap between the keeper 55 and its mating pole pieces 47 and 48, so most of the flux will pass through the movable keeper 46. The holding force on keeper 46 is given by the equation:

$$F = .577B^2Ax10^6 \text{ lbs.}$$

where B is the flux density in gauss and A is the pole face area inches squared.

The holding force is used to latch movable keeper 46 in engagement with poles 47 and 48 thereby compressing spring 54. Coil 58 wound on the fixed flux path 55, when energized in the correct direction with respect to the permanent magnets 43, changes the reluctance of the path through movable keeper 46, thereby transferring the majority of the flux to the fixed keeper 55 and unlatching the movable keeper 46. Spring 54 then trips open starter 10.

Thus, it can be seen that solenoid 50 is constructed to open starter 10 for normal motor operation and flux transfer assembly 45 is designed to open starter 10 under selected overload conditions. A third opening mechanism, linear slot motor or magnetic drive 60 is provided for opening starter 10 under current limiting situation. Magnetic drive 60 consists of a plurality of stacked lamination 62 with a slot 64 formed therein. A portion of bridging contact arm 34 is disposed in the narrow slot 64. On high overload current, such as 2500amperes, for a one hundred ampere NEMA Size One device, member 34 is rapidly drawn into slot 64. Magnetic drive 60 provides for a rapid motion of the rigid contact 34 thereby opening contacts 30 and 32 in a relatively short time. Bumper 42 is provided at the closed end of slot 64 cushioning the impact of bridging contact arm 34. The fault current will pass through bridging contact arm 34 which is disposed in slot 64. When a high current passes through arm 34 magnetic forces exerted on arm 34 draw it into slot 64 toward the closed end. The force acting on the conductor is given approximately by the equation:

$$F = -14.1 \text{ LI/W} \times 10^{-8} \text{ lbs.}$$

Where $L$ = length of the yoke in inches.
$I$ = current in amps.
$W$ = slot width in ihches.
Before the lamination material is saturated and $$F = .572B_{sat}\text{IL} \times 10^{-3} \text{ lbs.}$$

where $B_{sat}$ is the saturation flux density after the material is saturated.

The force provided by magnetic drive 60 is much larger than that which could be obtained from a spring for the same cost and available space. The magnetic drive mechanism has been specifically developed for current limiting applications. For a more complete explanation of the magnetic drive or slot motor concept see U.S. Pat. No. 3,815,059, issued to Leonard A. Spoelman and U.S. Pat. Application No. 437,586, (W.E. Case 42,971C). Space conductive arc extinguishing plates 68 are disposed in proximity to the ends of arcing rails 33 and 35. When the contacts 30 and 32 separate, arcs formed therebetween are driven off contacts 30 and 32, preventing excess erosion, down the arcing rails 33 and 35 to the Deion plates 68. Liners are used along the plates 68 to prevent the arcs from hanging up on the rails until they have almost reached the ends of the slots in the plates 68. The arcs are elongated along the diverging arcing rails 33 and 35 and are rapidly extinguished when they come into contact with the plates 68. Vents 70 are located at the end of the plates 68 to provide for gas venting.

It can be seen that a single movable contact arm 34, to which movable contacts 32 are attached, can be used for complete motor control over a variety of conditions. Solenoid 50 operates starter 10 during normal motor operations, flux transfer device 45 operates starter 10 during low to high current overload conditions, and magnetic drive 60 operates starter 10 during current limiting situations. Arc rails 33 and 35 and the plates 68 are provided for rapidly extinguishing any arc formed.

Figure 4:
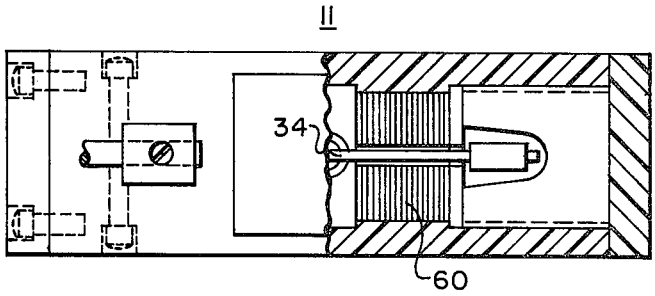
FIG. 4 is a top view partially in section of the motor shown in FIG. 3.
Figure 5:
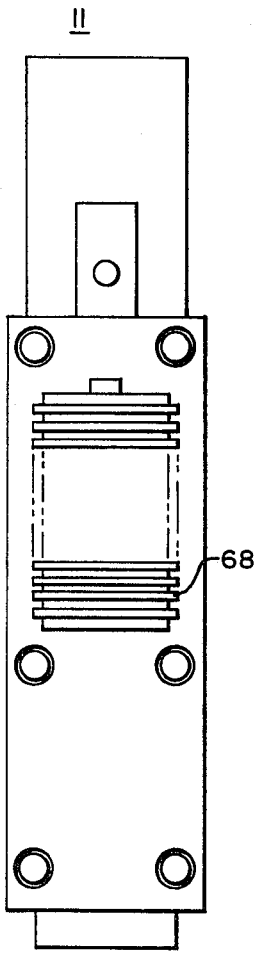
FIG. 5 is an end view of the motor-starter shown in FIG. 3.
Figure 3:
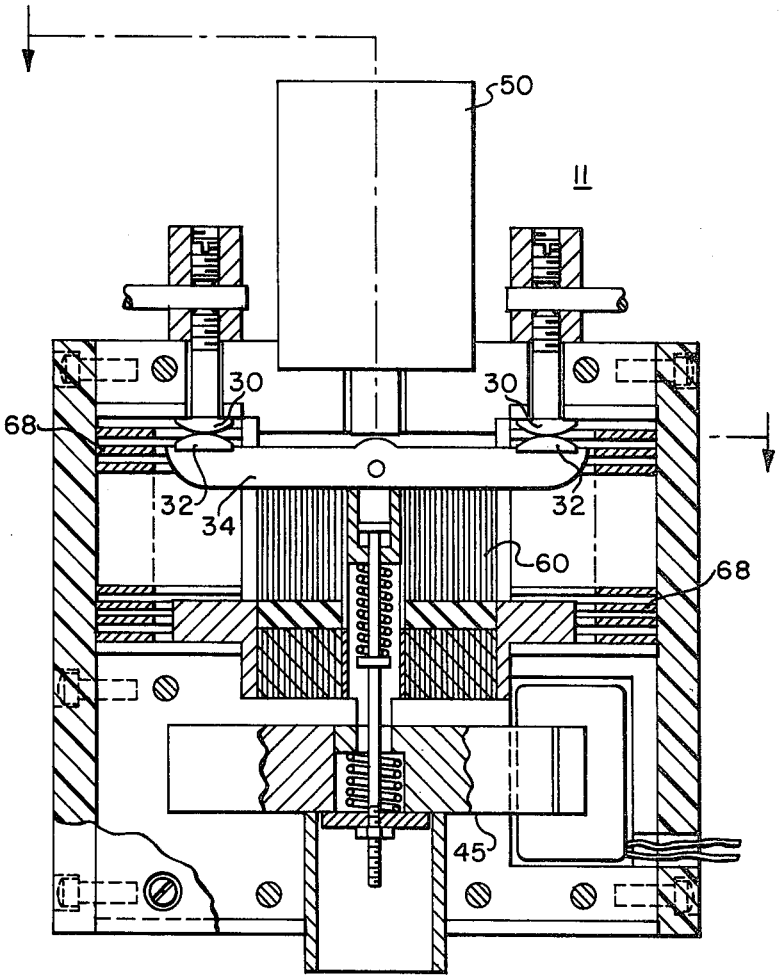
FIG. 3 is a side section view of a combination motor-starter circuit breaker illustrating another embodiment of the present invention.

Referring now to FIGS. 3, 4 and 5 there is shown another embodiment of a motor control starter 11 which utilizes the teaching of the present invention. Many of the features of circuit breaker 11 are similar to those shown for circuit breaker 10 and equivalent devices and members in FIGS. 3, 4 and 5 will be given the same numbers as those in FIGS. 1 and 2. Movable contact arm 34 on which spaced apart stationary contact 32 are attached is movable between a close position wherein contacts 32 engage contacts 30 and an open position wherein contacts 32 are separated from contact 30. Contact arm 34 for starter 11, however, is movable to a first open position by solenoid 50 and a second further spaced open position by flux transfer trip 45 or magnetic drive 60. That is, during normal motor operation electromagnet or solenoid 50 will operate to move contact arm 34 a relatively short distance such as one-quarter inch. However, during overcurrent operation by flux transfer trip 45 or current limiting by magnetic drive 60, contact arm 34 is moved a greater distance such as 1 inch. The laminated magnetic drive 60 allows very rapid acceleration of contact arm 34 for faults above 2500 amperes. The contact arm 34 can be moved 1 inch forming an arc length of two inches in approximately 2 milliseconds for a 100,000 RMS ampere possible fault. This rapid opening limits the peak let-through current to about 15,000 amperes. Any arc formed when contact arm 34 is opened is effectively extinguished by plates 68.

Starter 11, like starter 10, utilizes three operating means 45, 50 and 60 for operating starter 11 under various conditions to provide for complete motor operation and motor circuit protection.

Figure 6:
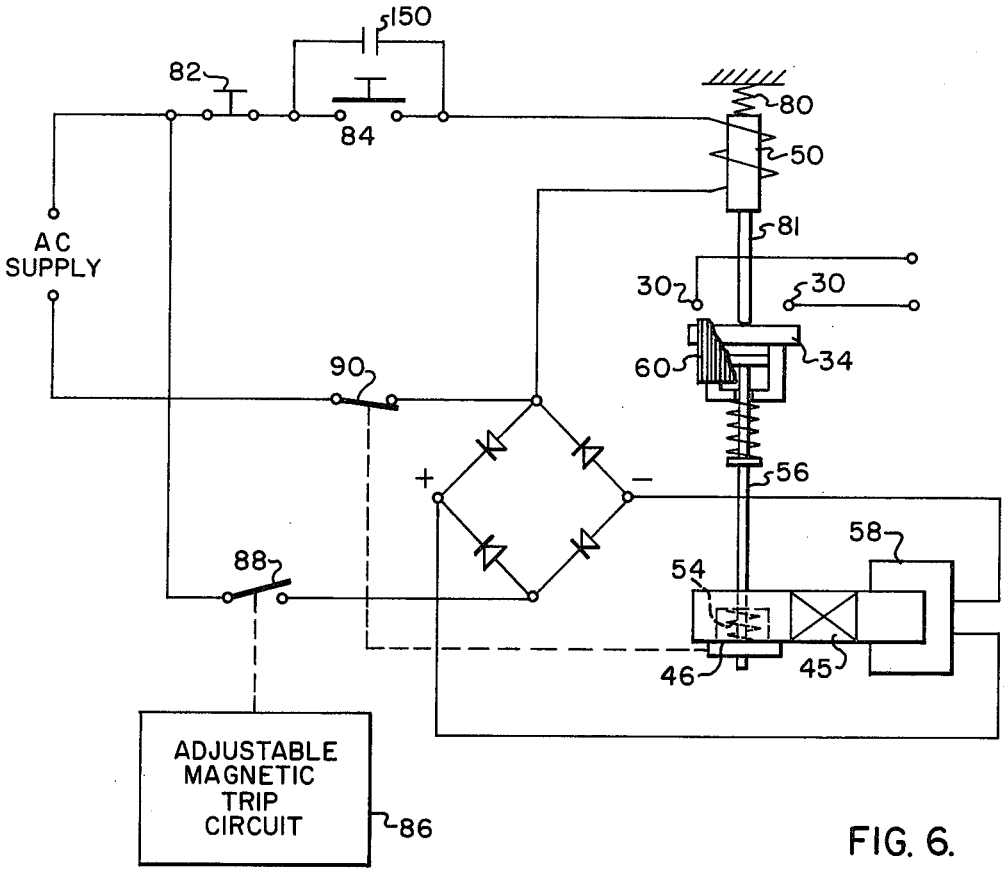
FIG. 6 is a schematic for interconnecting various operators of the disclosed motor-starter and circuit breaker.

The circuit shown in FIG. 6 is one method of typing together the various functions of starter 10 or 11. The movable portion of solenoid 50 is biased by spring 80 in a downward position. When solenoid 50 is unenergized, spring 80 forces contact arm 34 to the open position as shown in FIG. 6. When solenoid 50 is energized, operator 81 retracts allowing contact arm 34 to move to a closed position. Stop pushbutton 82 and start pushbutton 84 are provided for energizing and deenergizing solenoid 50 and the associated motor. A set of normally open contacts 150 can be provided in series with start button 84 for sealing in solenoid 50 when start button 84 is depressed. During normal operation opening and closing of starter 11 is controlled by the operation of pushbuttons 82 and 84. An adjustable magnetic trip 86 is connected to a normally opened contact 88. Adjustable magnetic trip circuit 86 can close contacts 88 as a function of current flow and/or time. When contact 88 is closed, a DC potential is applied to coil 58 releasing keeper 46 as described above. Under the influence of spring 54 keeper 46 moves to the open position. As keeper 46 moves to the open position, normally closed contacts 90 are moved to the open position. The opening of contacts 90 prevents solenoid 50 from being energized until flux trip assembly 45 has been reset. Magnetic drive 60 is provided for moving contact arm 34 to the open position in current limiting situations. When contact arm 34 moves to the open position under the influence of magnetic drive 60, shaft 56 will be forced downward separating keeper 46 from flux trip 45. Keeper 46 will then move to the unlatched position opening contact 90 and preventing coil 50 from being energized. Thus, when starter 11 is opened under the influence of flux trip 45 or magnetic drive 60, the starter coil 50 cannot be operated until keeper 46 is reset in the latch position. This is necessary otherwise it would be possible to close on a fault without having energy to trip open. When flux transfer device 45 is reset, starter 11 is then ready for normal operations.

What we claim is:

1. A motor starter current limiting circuit breaker combination comprising:

a housing;

separable contacts disposed within said housing and supported for relative movement between a closed position completing an electrical circuit therethrough and an open position interrupting an electric circuit therethrough;

electromagnet means supported within said housing and connected to said contacts for moving said contacts to the open position or closed position; and current tripping means supported within said housing and connected to said contacts for moving said contacts to the open position in response to an overcurrent condition above a first predetermined value, said current tripping means comprising first operating means for moving said contacts to the open position when current flow therethrough exceeds said first predetermined value, and second operating means for rapidly moving said contacts to the open position and providing current limiting when current flow therethrough exceeds a second predetermined value greater than said first predetermined value;

said electromagnet means, said first operating means, and said second operating means being connected to the same set of said contacts.

2. A motor starter current limiting circuit breaker combination as claimed in claim 1 wherein said second operating means for opening said set of contacts and providing current limiting comprises:

a member formed of ferromagnetic materials having a slot formed therein; and, a contact arm having one of said pairs of contacts attached thereto and being disposed within the slot formed in said member.

3. A motor starter current limiting circuit breaker combination as claimed in claim 1 wherein:

said electromagnet means, when causing said contacts to be in the open position, separates said contacts by a first distance; and, said current tripping means, when activated, separates said contacts by a second distance greater than the first distance.

4. A motor starter current limiting circuit breaker combination as recited in claim 1 wherein said current tripping means comprises spring biasing means for biasing said contacts to an open position, and said first operating means comprises latching means for holding said contacts in the closed position, said latching means being constructed to unlatch when current flow through said contacts exceeds said first predetermined value.

5. A motor starter current limiting circuit breaker combination as recited in claim 4 wherein said contacts comprise silver cadmium oxide.

6. A motor starter current limiting circuit breaker combination as claimed in claim 4 wherein said second operating means comprises:

a plurality of stacked laminations having a slot formed therein which is magnetically opened at one end and closed at the other end; and, a movable contact arm having at least one of said contacts attached thereto disposed in proximity to the open slot end in said plurality of stacked laminations.

7. A motor starter current limiting circuit breaker combination as claimed in claim 6 wherein:

said latching means comprises a permanent magnet;

a pair of pole pieces disposed on opposite poles of said permanent magnet;

a movable keeper movable between a latching position in engagement with said pair of pole pieces and forming a magnetic flux path for said permanent magnet and an unlatching position spaced apart from said pair of pole pieces; and, connecting means connecting said movable keeper to said movable contact arm.

8. A motor starter current limiting circuit breaker combination as claimed in claim 6 comprising a plurality of spaced apart ferromagnetic plates disposed in proximity to said pair of contacts, each of said plates having a U-shaped opening formed therein.

9. A motor starter current limiting circuit breaker combination as claimed in claim 1 comprising:

a first arcing rail extending from one of said contacts; and, a second arcing rail electrically connected to another of said contacts and extending in a diverging relationship with said first arcing rail.

10. A motor starter comprising:

a housing;

a pair of stationary spaced apart contacts disposed in said housing;

a bridging contact arm;

a pair of movable contacts disposed in spaced apart relationship on said bridging contact arm;

a solenoid supported within said housing and connected to said bridging contact arm to move said bridging contact arm between a closed position, wherein said pair of movable contacts engage said pair of stationary contacts, and an open position, wherein said pair of movable contacts are spaced apart from said pair of stationary contacts; and, current tripping means supported within said housing and operable independent of said solenoid and being connected to said bridging contact arm for moving said bridging contact arm to an open position in response to a predetermined excess current flow through the motor starter, said tripping means comprising:

latching means spring biased to an unlatched position and connected to said bridging contact arm for unlatching and moving said bridging contact arm to an open position when current flow exceeds a first current level, and current limiting means connected to said bridging contact arm for rapidly moving said bridging contact arm to an open position and thus providing current limiting when current flow exceeds a second current level greater than the first current level.

11. A motor starter as claimed in claim 10 comprising:

a first pair of arcing rails extending from said pair of stationary contacts; and, a second pair of arcing rails electrically connected to said pair of movable contacts and extending in a diverging relationship with said first pair of arcing rails.

12. A motor starter as claimed in claim 11 wherein when said bridging contact arm is in the open position said pair of movable contacts are separated from said pair of stationary contacts by a relatively small separation less than one/half inch.

13. A motor starter as claimed in claim 10 wherein said current limiting means comprises:

a magnetic member having a magnetically opened slot formed therein; and, said bridging contact arm is disposed within and in proximity to the open end of the slot formed in said magnetic member.

14. A motor starter as claimed in claim 10 wherein:

said solenoid can move said bridging contact to an open position wherein said stationary contacts are separated from said movable contacts by a first distance; and, said circuit tripping means can move said bridging contact arm to an open position wherein said stationary contacts are separated from said movable contacts by a second distance greater than the first distance.

15. A combination circuit breaker and motor starter comprising:

a stationary contact;

a movable contact disposed for movement into and out of engagement with said stationary contact;

motor operating means connected to said movable contacts for moving said movable contacts in response to external activation;

circuit breaker means connected to said movable contact for moving said movable contact out of engagement with said stationary contact when current flow through the combination circuit breaker and motor starter exceed a first predetermined level; and, current limiting means connected to said movable contact for very rapidly moving said movable contact out of engagement with said stationary contact and providing current limiting when the current flow through the combination circuit breaker and motor starter exceeds a second predetermined level greater than the first predetermined current level.

16. A combination circuit breaker and motor starter as claimed in claim 15 wherein said current limiting means comprises:

a magnetic drive member formed of a magnetizable material having an open slot formed therein; and, a movable contact arm having said movable contact supported thereon being disposed in the open end of the slot formed in said magnetic drive member.

17. A combination circuit breaker and motor starter as claimed in claim 15 comprising a first arcing rail extending from said stationary contacts; and, a second arcing rail electrically connected to said movable contacts and extending in a diverging relationship with said first arcing rail; and, a flexible shunt connecting said second arcing rail to said movable contacts.

18. A combination circuit breaker and motor starter as claimed in claim 15 wherein:

said motor operating means move said movable contacts to a position separated from said stationary contacts by a first fixed distance; and, said circuit breaker means move said movable contacts to an open position separated from said stationary contacts by a second fixed distance greater than the first fixed distance.

* * * * *